United States Patent [19]

Schreiner

[11] Patent Number: 4,551,301

[45] Date of Patent: Nov. 5, 1985

[54] SINTERED COMPOUND MATERIAL FOR ELECTRICAL CONTACTS AND METHOD FOR ITS PRODUCTION

[75] Inventor: Horst Schreiner, Nuremberg, Fed. Rep. of Germany

[73] Assignee: Siemens Aktiengesellschaft, Berlin and Munich, Fed. Rep. of Germany

[21] Appl. No.: 577,748

[22] Filed: Feb. 7, 1984

[30] Foreign Application Priority Data

Feb. 16, 1983 [DE] Fed. Rep. of Germany ..... 3305270

[51] Int. Cl.[4] ..... B22F 1/00

[52] U.S. Cl. ..... 419/21; 419/22; 75/234; 75/235; 148/126.1; 428/569; 428/929

[58] Field of Search ..... 419/21, 22; 75/234, 75/235; 148/126.1; 428/929, 569

[56] References Cited

U.S. PATENT DOCUMENTS 4,141,727 2/1979 Shida et al. ..... 419/21

*Primary Examiner*—Stephen J. Lechert, Jr.

*Attorney, Agent, or Firm*—Karl F. Milde, Jr.

[57] ABSTRACT

AgCdO based contact elements are replaced in contactors and small circuit breakers with CdO-less type elements which exhibit little burn-off in the arc, a low welding force and minimal heating when carrying continuous current. However, known $AgSnO_2$ contact materials do not have optimum values in all operationally important properties. In these contact materials a more firmly adhering oxide layer occurs as compared with AgCdO. The invention relates to a sintered compound material for electrical contacts, consisting of $AgSnO_2Bi_2O_3CuO$ and containing at least one other metal oxide additive which sublimes below the melting temperature of silver. The $SnO_2$, $Bi_2O_3$ and CuO are globularly precipitated in silver material structure zones having a maximum diameter of 200 μm, and the metal oxide additive is distributed on the surfaces of the boundary regions of these microscopic silver zones.

18 Claims, No Drawings

SINTERED COMPOUND MATERIAL FOR ELECTRICAL CONTACTS AND METHOD FOR ITS PRODUCTION

BACKGROUND OF THE INVENTION

The invention relates to a sintered compound material of silver, stannic oxide, bismuth oxide and copper oxide for use in electrical contacts and to a method for its production.

For many applications, AgCdO has served very well for the manufacture of electrical contact elements. Because it contaminates the environment, however, CdO has been classified as a toxic material. Attempts have therefore been made to replace CdO by another metal oxide. It has turned out that stannic oxide ($SnO_2$) is a suitable substitute for cadmium oxide (CdO), although $AgSnO_2$ contact materials still do not have optimum values in all the operationally important properties. For instance, $AgSnO_2$ contact materials exhibit a more firmly adhering oxide layer than do AgCdO contact materials.

The European Pat. No. 0,024,349 discloses a material for electrical contacts consisting of silver, stannic oxide and another metal oxide. This known contact material contains stannic oxide and tungsten oxide, in a certain specified composition, as well as silver.

SUMMARY OF THE INVENTION

It is an object of the invention to improve the CdO-less silver contact elements so as to optimize the contact properties and thus provide low arc burn-off, a weak welding force and small contact resistance.

This object, as well as other objects which will become apparent in the discussion that follows, are achieved, according to the invention, by providing a sintered compound material of silver with stannic oxide, bismuth oxide and copper oxide ($AgSnO_2Bi_2CuO$) and at least one other metal oxide additive which sublimes below the melting temperature of silver. The stannic oxide, the bismuth oxide and the copper oxide are precipitated globularly in silver structure zones which have a maximum diameter of 200 μm and the metal oxide additive is distributed on the surfaces of the boundary regions of these silver zones.

It has proven to be particularly advantageous when the mean particle sizes of the tin oxide, bismuth oxide and copper oxide precipitations in the silver zones are between 0.1 and 5 μm, in particular between 0.1 and 3 μm.

Furthermore, it is advantageous if the tin oxide share is between 6 and 15 percent by weight, the bismuth oxide share is between 0.2 and 2 percent by weight, the copper oxide share is between 0.2 and 2 percent by weight and the share of sublimed metal oxide additive is between 0.2 and 2 percent by weight.

The following compositions have proven to be particularly suitable for the subliming metal oxide additive(s): (1) molybdenum oxide ($MoO_3$) with a share of 0.5 percent by weight; (2) tungsten oxide ($WO_3$) with a share of 0.8 percent by weight; or (3) tungsten oxide ($WO_3$) with a share of 0.5 percent by weight and together with molybdenum oxide ($MoO_3$) with a share of 0.2 percent by weight.

The silver zones with the globular oxide precipitations of tin oxide, bismuth oxide and copper oxide in the contact material according to the invention serve to provide very favorable arcing characteristics. The subliming metal oxides located on the surfaces of these silver zones produce small silver islands, under arc loads, from which the metal oxides sublime below the melting point of silver, thus avoiding a coherent cover layer of oxides. A marked reduction of the contact resistance is obtained through this mechanism, without increasing the welding force.

DETAILED DESCRIPTION OF THE INVENTION

The invention will now be explained in greater detail by way of two embodiment examples.

EXAMPLE 1

A powder of particle size smaller than 200 μm is produced from an AgSnBiCu alloy with 7.7 percent by weight tin (Sn), 1 percent by weight bismuth (Bi) and 1 percent by weight copper (Cu). One suitable method of doing this is by pressure atomization of this molten alloy. The alloy powder obtained is completely internally oxidized so that a compound powder $AgSnO_2$-$Bi_2O_3CuO$ of corresponding composition is obtained. The internal oxidation is carried out in air, with the heat treatment starting at 500° C., increased after one hour to 800° C. and kept there for another hour. The compound powder is mixed with 0.8 percent by weight tungsten oxide ($WO_3$) in an agitated ball mill in the presence of acetone for one hour, thereby distributing the $WO_3$ over the surfaces of the compound powder particles.

After this powder mixture has dried, a blank is produced by pressing, sintering and hot compaction, the residual porosity of the blank being less than 1.5 percent. The electrical contact properties, such as are burn-off, welding force and contact resistance were measured in a test switch under conditions described in the literature and compared with a very good quality AgCdO contact. The burn-off values were 25 percent lower, so that a corresponding improvement in useful life can be expected. This makes possible a corresponding saving of silver by reducing the contact element volume. The welding force values were within the AgCdO12 range, as was the contact resistance.

EXAMPLE 2

As in Example 1, a powder of particle size less than 200 μm is produced from an AgSnBiCu alloy with 7.7 percent by weight tin (Sn), 1 percent by weight bismuth (Bi) and 1 percent by weight copper (Cu) by pressure atomization of the molten alloy. A completely internally oxidized $AgSnO_2Bi_2O_3CuO$ compound powder is obtained by the internal oxidation of the alloy powder under the conditions stated in Example 1. The compound powder is then milled with 0.4 percent by weight tungsten oxide powder ($WO_3$) and 0.2 percent by weight molybdenum oxide powder ($MoO_3$) in an agitated ball mill in the presence of acetone for one hour so that the oxide additives are evenly distributed on the surfaces of the compound powder particles. After the powder mixture has dried, a blank is produced by pressing, sintering and hot compaction, to the point where the residual porosity is less than 1.5 percent. The contact properties were measured in a test switch described in the literature and found to be just as outstanding as in the contact material described in Example 1.

There has thus been shown and described a novel compound material for electrical contacts which fulfills all the objects and advantages sought therefor. Many changes, modifications, variations and other uses and applications of the subject invention will, however, become apparent to those skilled in the art after considering this specification which discloses preferred embodiments thereof. All such changes, modifications, variations and other uses and applications which do not depart from the spirit and scope of the invention are deemed to be covered by the invention which is limited only by the claims which follow.

What is claimed is:

1. In a sintered compound material of silver, stannic oxide, bismuth oxide and copper oxide ($AgSnO_2Bi_2O_3$-CuO) for use as an electrical contact, wherein the mean particle sizes of the stannic oxide, bismuth oxide and copper oxide in the silver material structure zones are between 0.1 and 5 μm, and wherein the stannic oxide share is between 6 and 15 percent by weight, and both the bismuth oxide share and the copper oxide share are each between 0.2 and 2 percent by weight, the improvement wherein the material contains at least one other metal oxide additive which sublimes below the melting temperature of silver and which forms a share of the material between 0.2 and 2 percent by weight; wherein the stannic oxide, the bismuth oxide and the copper oxide are globularly precipitated in silver material structure zones having a maximum diameter of 200 μm; and wherein the metal oxide additive is distributed on the surface of these structure zones of silver, stannic oxide, bismuth oxide and copper oxide.

2. The sintered compound material according to claim 1, wherein the mean particle sizes of the stannic oxide, bismuth oxide, and copper oxide precipitations in the silver zones are between 0.1 μm and 3 μm.

3. The sintered compound material according to claim 1, wherein molybdenum oxide ($MoO_3$) with a share of 0.5 percent by weight is the subliming metal oxide additive.

4. The sintered compound material according to claim 1, wherein molybdenum oxide ($MoO_3$) with a share of 0.5 percent by weight is the subliming metal oxide additive.

5. The sintered compound material according to claim 2, wherein molybdenum oxide ($MoO_3$) with a share of 0.5 percent by weight is the subliming metal oxide additive.

6. The sintered compound material according to claim 1, wherein molybdenum oxide ($MoO_3$) with a share of 0.5 percent by weight is the subliming metal oxide additive.

7. The sintered compound material according to claim 1, wherein tungsten oxide ($WO_3$) with a share of 0.8 percent by weight is the subliming metal oxide additive.

8. The sintered compound material according to claim 1, wherein tungsten oxide ($WO_3$) with a share of 0.8 percent by weight is the subliming metal oxide additive.

9. The sintered compound material according to claim 2, wherein tungsten oxide ($WO_3$) with a share of 0.8 percent by weight is the subliming metal oxide additive.

10. The sintered compound material according to claim 1, wherein tungsten oxide ($WO_3$) with a share of 0.8 percent by weight is the subliming metal oxide additive.

11. The sintered compound material according to claim 1, wherein tungsten oxide ($WO_3$) with a share of 0.5 percent by weight and molybdenum oxide ($MoO_3$) with a share of 0.2 percent by weight are the subliming metal oxide additives.

12. The sintered compound material according to claim 1, wherein tungsten oxide ($WO_3$) with a share of 0.5 percent by weight and molybdenum oxide ($MoO_3$) with a share of 0.2 percent by weight are the subliming metal oxide additives.

13. The sintered compound material according to claim 2, wherein tungsten oxide ($WO_3$) with a share of 0.5 percent by weight and molybdenum oxide ($MoO_3$) with a share of 0.2 percent by weight are the subliming metal oxide additives.

14. The sintered compound material according to claim 1, wherein tungsten oxide ($WO_3$) with a share of 0.5 percent by weight and molybdenum oxide ($MoO_3$) with a share of 0.2 percent by weight are the subliming metal oxide additives.

15. A method for producing a sintered compound material according to claim 1, comprising the steps of internally oxidizing an AgSnBiCu alloy powder of a given composition to an $AgSnO_2Bi_2O_3CuO$ compound powder, and mixing the $AgSnO_2Bi_2O_3CuO$ compound powder with a given quantity of a metal oxide that sublimes below the melting temperature of silver in an agitated mill in the presence of acetone, whereby the metal oxide additive is distributed on the surfaces of the compound powder particles.

16. A method for producing a sintered compound material according to claim 1, comprising the steps of internally oxidizing an AgSnBiCu alloy powder of a given composition to an $AgSnO_2Bi_2O_3CuO$ compound powder, and mixing the $AgSnO_2Bi_2O_3CuO$ compound powder with a given quantity of a metal oxide that sublimes below the melting temperature of silver in an agitated mill in the presence of acetone, whereby the metal oxide additive is distributed on the surfaces of the compound powder particles.

17. A method for producing a sintered compound material according to claim 2, comprising the steps of internally oxidizing an AgSnBiCu alloy powder of a given composition to an $AgSnO_2Bi_2O_3CuO$ compound powder, and mixing the $AgSnO_2Bi_2O_3CuO$ compound powder with a given quantity of a metal oxide that sublimes below the melting temperature of silver in an agitated mill in the presence of acetone, whereby the metal oxide additive is distributed on the surfaces of the compound powder particles.

18. A method for producing a sintered compound material according to claim 1, comprising the steps of internally oxidizing an AgSnBiCu alloy powder of a given composition to an $AgSnO_2Bi_2O_3CuO$ compound powder, and mixing the $AgSnO_2Bi_2O_3CuO$ compound powder with a given quantity of a metal oxide that sublimes below the melting temperature of silver in an agitated mill in the presence of acetone, whereby the metal oxide additive is distributed on the surfaces of the compound powder particles.

* * * * *